United States Patent [19]

Wilkinson

[11] Patent Number: 4,648,593

[45] Date of Patent: Mar. 10, 1987

[54] DEVICE FOR SIMULATION OF CLIMBING

[76] Inventor: William T. Wilkinson, Morris Farm, Rte. 841, Kemblesville, Pa. 19347

[21] Appl. No.: 784,536

[22] Filed: Oct. 4, 1985

Related U.S. Application Data

[63] Continuation-in-part of Ser. No. 628,045, Jul. 5, 1984, abandoned, which is a continuation-in-part of Ser. No. 541,879, Oct. 14, 1983, abandoned, which is a continuation-in-part of Ser. No. 388,881, Jun. 16, 1982, Pat. No. 4,561,652, which is a continuation-in-part of Ser. No. 235,419, Feb. 17, 1981, Pat. No. 4,340,218.

[51] Int. Cl.[4] ..... A63B 23/04

[52] U.S. Cl. ..... 272/70; 182/92; 182/120

[58] Field of Search ..... 272/70, 93, 134, 144, 272/DIG. 4, 136, 69; 182/92, 97, 120, 106

[56] References Cited

U.S. PATENT DOCUMENTS

| | | | |
|---|---|---|---|
| D. 199,972 | 1/1965 | Struben . | |
| 982,882 | 1/1911 | Schimmel . | |
| 1,285,817 | 11/1918 | Sklar | 182/120 |
| 1,615,135 | 1/1927 | Putnam | 182/120 |
| 2,097,273 | 10/1937 | Feist . | |
| 2,214,052 | 10/1940 | Good . | |
| 2,241,833 | 5/1941 | Waller . | |
| 2,524,971 | 10/1950 | Gray . | |
| 2,873,056 | 2/1959 | Gratton | 182/97 |
| 3,035,671 | 5/1962 | Sicherman . | |
| 3,112,811 | 12/1963 | Moran . | |
| 3,268,031 | 8/1966 | Hampson . | |
| 3,464,518 | 9/1969 | Stelovich | 182/120 |
| 3,497,215 | 2/1970 | Harrison . | |
| 3,528,652 | 9/1970 | Tarbox . | |
| 3,532,356 | 10/1970 | Lillibridge . | |
| 3,608,256 | 9/1971 | Jefferys . | |
| 3,743,283 | 7/1973 | Garrett . | |
| 3,970,302 | 7/1976 | McFee . | |
| 4,072,309 | 2/1978 | Wilson . | |
| 4,239,211 | 12/1980 | Wilkinson . | |
| 4,289,215 | 9/1981 | Robinson . | |
| 4,316,524 | 2/1982 | Lapeyre . | |
| 4,421,206 | 12/1983 | Kümmerlin | 182/106 X |

FOREIGN PATENT DOCUMENTS

| | | | |
|---|---|---|---|
| 0073744 | 3/1983 | European Pat. Off. . | |
| 45140 | 1/1888 | Fed. Rep. of Germany . | |
| 49111 | 4/1889 | Fed. Rep. of Germany . | |
| 523174 | 4/1931 | Fed. Rep. of Germany . | |
| 2006488 | 3/1971 | Fed. Rep. of Germany | 182/120 |
| 2243794 | 9/1972 | Fed. Rep. of Germany . | |
| 2500591 | 7/1976 | Fed. Rep. of Germany . | |
| 1432392 | 2/1966 | France . | |
| 1463005 | 11/1966 | France . | |
| 19659 | of 1889 | United Kingdom | 182/97 |
| 791081 | 2/1958 | United Kingdom . | |
| 1333291 | 10/1973 | United Kingdom . | |
| 2010101 | 6/1979 | United Kingdom . | |
| 1552415 | 9/1979 | United Kingdom . | |
| 1568081 | 5/1980 | United Kingdom . | |
| 2076664 | 12/1981 | United Kingdom . | |

*Primary Examiner*—Richard J. Apley
*Assistant Examiner*—Robert W. Bahr
*Attorney, Agent, or Firm*—Harold Pezzner

[57] ABSTRACT

An exercising device for the simulation of climbing includes a pair of side support units, each of which comprises a front leg and a back leg pivotally connected at their upper ends. The front and back legs of each pair are interconnected by a support member. A step in the form of a horizontal support platform is selectively engaged with the side support units at one of a plurality of different elevations so that the user may simulate climbing by repeatedly stepping up and down from the platform.

21 Claims, 8 Drawing Figures

DEVICE FOR SIMULATION OF CLIMBING

CROSS-REFERENCE TO RELATED APPLICATIONS

This application is a continuation-in-part of application Ser. No. 628,045 filed July 5, 1984 abandoned, which in turn is a continuation-in-part of application Ser. No. 541,879 filed Oct. 14, 1983 abandoned, which in turn is a continuation-in-part of application Ser. No. 388,881 filed June 16, 1982 now U.S. Pat. No. 4,561,652. The last mentioned application is a continuation-in-part of application Ser. No. 235,419 filed Feb. 17, 1981 now U.S. Pat. No. 4,340,218.

BACKGROUND OF THE DISCLOSURE

The present invention is directed to the simulation of climbing. This form of exercise is superior in aerobic value to other forms of exercise presently in wide use. In my U.S. Pat. No. 4,340,218 I disclosed an arrangement involving single step climbing wherein a pair of side supports were provided with sets of horizontal grooves so that a platform could be selectively placed in an appropriate set of grooves at the desired elevation for climbing exercise. My patent also disclosed providing resistance means specifically in the form of springs anchored at one end to a support surface with the other end secured to the user.

In application Ser. No. 388,881 I disclosed a variation wherein the resistance means took the form of a sleeve worn, for example, at the user's ankles. The sleeve had removable weights to offer the desired resistance.

The aforenoted patent and application were concerned with the partial similation of climbing in that the user stepped up and down from the platform. Application Ser. No. 541,879 was directed not only to the partial simulation of climbing but also disclosed arrangements for the continuous simulation of climbing where the user continuously stepped in the same direction rather than stepping forward and backward.

Application Ser. No. 628,045 was also directed to various forms for the partial simulation of climbing. In that application, however, the forms took a structural approach different than that previously described in that certain of the embodiments include side support units wherein each unit includes front and back legs pivoted at their upper ends with the units being interconnected and with the step being a removable horizontal platform. The application in particular claimed the method aspects of practicing the invention.

SUMMARY OF THE INVENTION

An object of this invention is to provide a device for the simulation of climbing along the lines of parent application Ser. No. 628,045.

A further object of this invention is to provide such a device which may be conveniently used during periods of exercise and conveniently stored during inactive periods.

In accordance with this invention, the exercise device for simulating climbing comprises a frame which consists of a pair of side support units. Each unit, in turn, comprises a front leg and a back leg pivotally mounted at the upper ends with a brace interconnecting each pair of front and back legs. The support units themselves are interconnected by a support member to fix the distance between the units. A plurality of vertically spaced mounting elements are provided on each of the front legs in association with each other whereby a mounting element from one leg and a corresponding mounting element from the other leg forms a set. A step in the form of a horizontal platform is selectively engaged in one of the sets of mounting elements. The step bridges the support units and is completely removable therefrom. In addition the step is the forwardmost horizontal strutural element which bridges the support units. The step comprises the sole adjustable support platform for the device whereby a user may select the desired elevation for the step and then simulate climbing by repeatedly stepping up and down from the platform.

In a preferred practice of this invention, the step has a width of greater dimension than the width of the front legs to which the step is mounted. The step may also comprise the uppermost platform of the device.

In the preferred practice of this invention, resistance means are provided which may be weights carried by the user or mounted to the user such as by means of ankle sleeves.

THE DRAWINGS

DETAILED DESCRIPTION

Figure 3:
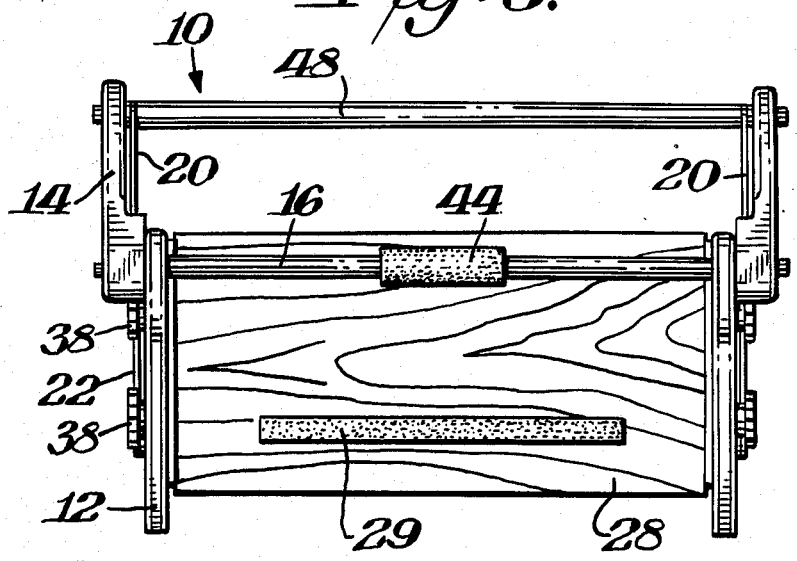
FIGS. 3–4 are top and bottom plan views of the device shown in FIGS. 1–2.

The subject matters of parent application Ser. No. 628,045 filed July 5, 1984 and of related applications Ser. No. 722,617 filed Apr. 12, 1985, Ser. No. 541,879 filed Oct. 14, 1983 and Ser. No. 388,881 filed June 16, 1982 as well as U.S. Pat. No. 4,340,218 are incorporated herein by reference thereto.

FIGS. 1–4 illustrate device 10 for the simulation of climbing. Device 10 includes a frame in the form of a pair of support units. Each support unit comprises a front leg 12 and a back 14 pivotally connected at their uppers ends. Parent application Ser No. 628,045 discloses forms in which the pivotal connection of the front and rear legs is by means of intermediate members to which the individual legs in turn are connected. The present invention may be practiced by such pivotal connection. As illustrated herein, however, the pivotal connection is preferably by mounting the legs to a common shaft or post 16 which in turn interconnects the pair of side support untis to each other. Legs 12 and 14 of each pair are also interconnected by a brace 18 of conventional construction comprising a pair of individual members 20, 22, each of which is pivoted at one end to a respective leg and the other ends are pivoted to each other with a locking element 24 being provided for maintaining members 20 and 22 locked in alignment at the fully opened position. As later discussed, this particular arrangement of brace 18 is desirable in that it allows complete collapse of legs 12, 14 in their storage condition while providing a stable mounting for the legs at their fully opened position.

Figure 2:
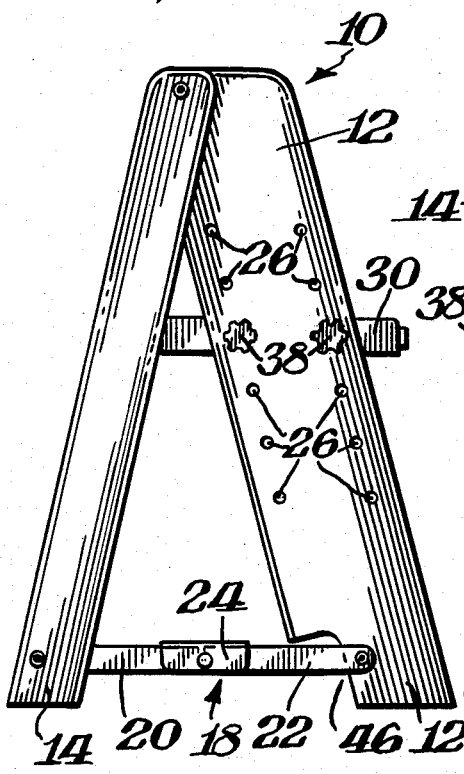
FIG. 2 is a side elevation view of the device shown in FIG. 1.
Figure 1:
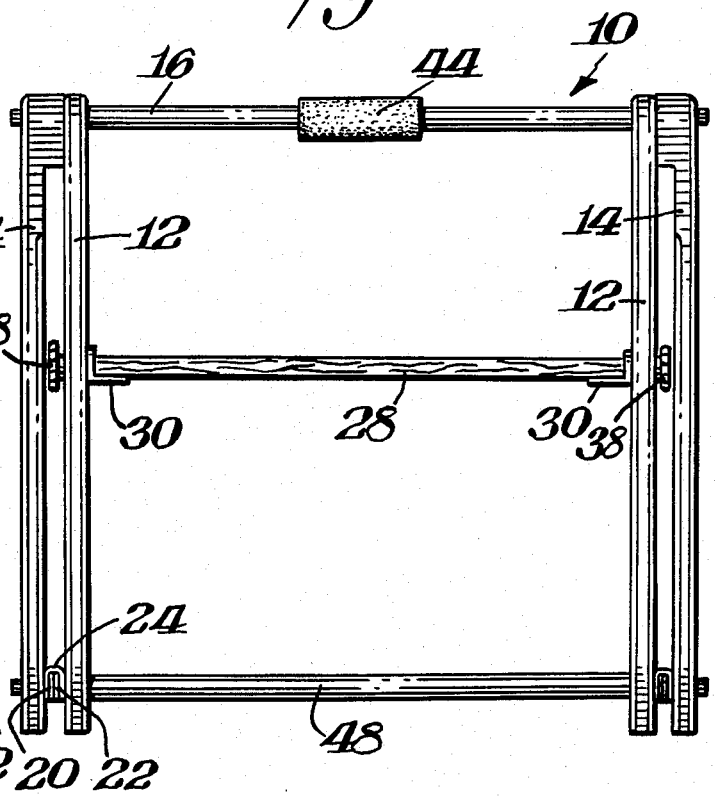
FIG. 1 is a front elevation view of a device for the simulation of climbing in accordance with this invention.
Figure 4:
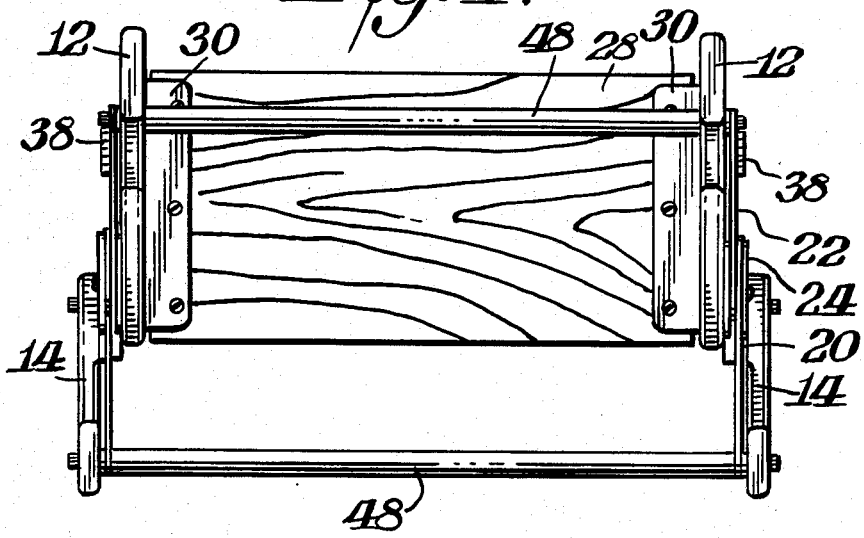
Figure 7:
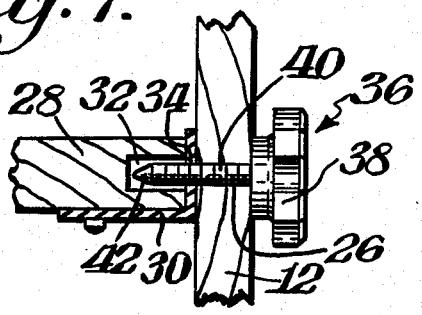
FIG. 7 is a front elevation view partly in section of a portion of the device shown in FIGS. 1–6.

As shown in FIG. 2, each front leg 12 is provided with a plurality of vertically spaced mounting elements. In the illustrated form, the mounting elements include pairs of horizontally aligned holes 26. Each pair of mounting elements or holes 26 of one front leg 12 would be associated with and co-planar with a corresponding pair of mounting elements in the other front leg thus resulting in a set of mounting elements being formed by the corresponding pairs of mounting elements. In this manner a plurality of vertically spaced sets of mounting elements are provided on front legs 12, 12. Device 10 also includes a step 28 in the form of a horizontal support platform. Step 28 is selectively engaged to one of the sets of mounting elements 26 so that the step 28 is horizontally disposed at one of a plurality of different elevations. FIG. 7 illustrates the manner of securing step 28 to the mounting elements 26. As shown therein, step 28 includes an L-shaped bracket 30 along each side edge thereof. A pair of pockets or recesses 32 are provided in step 28 along each side edge thereof spaced apart a distance corresponding to the spacing of holes 26. The vertical leg of bracket 30 includes a pair of holes 34 aligned with holes 32. Holes 34 are preferably internally threaded although they may be smooth. A pair of fasteners 36 is provided for each leg 12. Fasteners 36 include a hand gripping knob and a shaft or pin 40. Shaft 40 is preferably externally threaded but terminates in a smooth pointed end 42.

In operation the user would determine the desired vertical elevation in accordance with the exercise program. Step or platform 28 would then be placed between front legs 12 at that elevation with the holes 34 generally aligned with holes 26 in front legs 12. Fasteners 36 would then be inserted through holes 20 and into holes 34. As pointed ends 42 enter holes 34, automatic alignment of holes 26 and holes 34 would thereby be achieved. Fasteners 36 would be inserted into recesses 32 as far as a possible to securely mount step 28 to the pair of legs 12, 12. As previously indicated in the preferred practice of this invention, holes 34 are threaded for threaded engagement with shafts 40. If desired, holes 26 may also be threaded such as by threading the holes themselves or by providing internally threaded sleeves or nuts within or otherwise associated with holes 26.

If it is desired to change the elevation platform 28 or to completely remove the platform, fasteners 36 are conveniently disengaged platform 28 may be removed.

As best illustrated in FIGS. 2 and 3, platform 28 is the forwardmost horizontal structural support element bridging the support units. In addition the step or platform 28 is also the sole adjustable support platform of the device. As a result, the device does not include any extraneous structure which would interfere with the user selecting the proper elevation and then simulating climbing by continuously stepping up and down from the platform.

As best shown in FIG. 2, platform 28 has a width of a dimension longer than the width of front legs 12. As illustrated, platform 28 thus projects forwardly and rearwardly beyond front legs 12. This is in keeping with minimizing the dimension of elements such as the frame support units so as to take advantage of their support functions while not adding extra weight to the device and of selecting dimensions for platform 28 which would be most suitable to provide a sufficient support surface area for the stepping up and stepping down. In addition, platform 28 may be provided with non-skid strips 29.

It is noted that this arrangement differs significantly from, for example, step ladders where the steps are generally of the same width as the support units and do not extend forwardly from the support units. In addition, with conventional step ladders a plurality of individual steps are provided which are generally narrow since they support only a portion of the user's foot. Device 10 also differs from step ladders in that, as illustrated, the adjustable step is actually the uppermost support platform bridging the support units since shaft 16 is not intended to function as a support platform and its narrow dimensions would, in fact, prevent such support functioning.

Device 10 can be formed of any suitable dimensions. The proportions of the various elements in device 10 are shown in FIGS. 1–6 which are drawn to scale at a 5 1/2:1 ratio. In the preferred practice of this invention step 28 is 9½ inches wide by 20 inches long to provide a suitable support area to support the entire foot of the user. Support elements 26 cover a vertical elevation range above the ground of 8 inches to 18 inches with the pairs of elements being spaced at 2 inch increments.

Shaft 16 functions not only to interconnect the pairs of support units and to provide a means for pivotally connecting each front leg 12 with its respective rear leg 14, but also shaft 16 functions as a convenient handle for carrying device 10. To enhance this function, a padded sleeve 44 is provided around shaft 16 to add comfort to the user.

Figure 6:
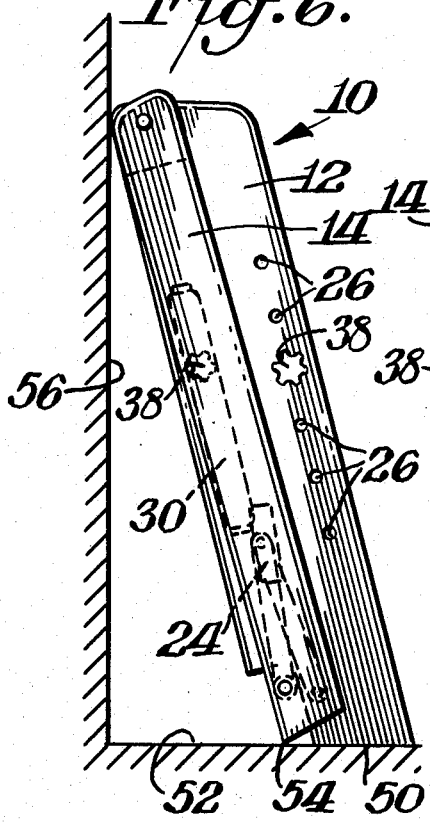
FIG. 6 is a side elevation view of the device shown in FIG. 5.
Figure 5:
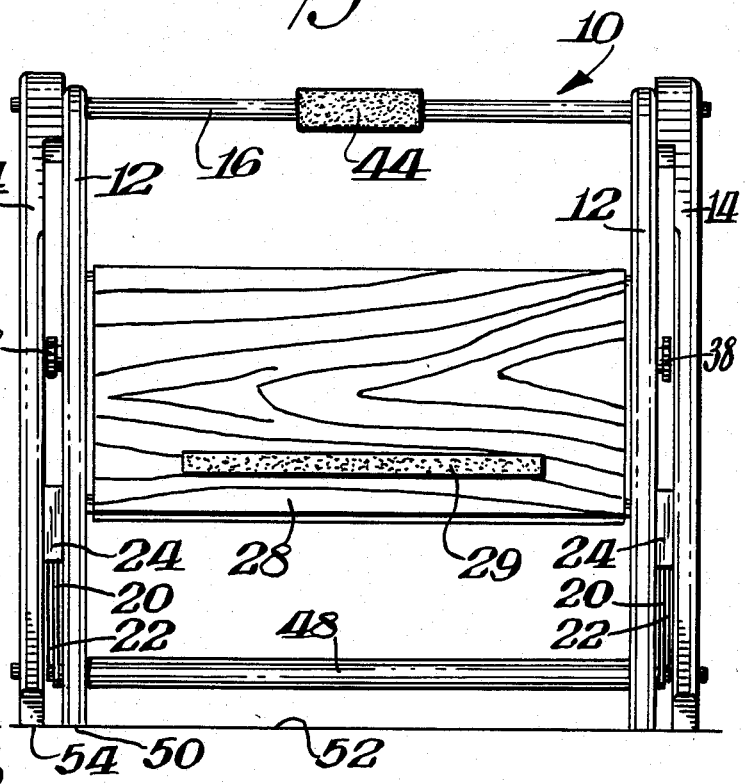
FIG. 5 is a front elevation view of the device shown in FIGS. 1–4 in its collapsed condition.

FIGS. 5–6 show device 10 in its collapsed or stored condition. As shown in FIG. 5, each front leg 12 is spaced from its corresponding back leg 14 by a distance sufficient to accommodate fastener 36. In the stored condition, it is possible to maintain the platform 28 engaged with the front legs 12 but pivoted into alignment with the front legs, rather than being perpendicular thereto, by maintaining only one fastener from each front leg in engagement with platform 28. The other fastener may be removed and inserted in other holes 26.

As shown in FIG. 2, each front leg 12 includes a notch or cutaway portion 46. Notches 46 accommodate rod 48 during the collapsed condition of device 10. Rod 48 functions to interconnect back legs 14 for added stability to device 10 in its operative condition.

As shown in FIG. 6, when device 10 is in the collapsed condition, the entire lower edge 50 of each front leg 12 rests upon the floor 52, while the remote corner 54 of each rear leg 14 is in line with lower edges 50 to also rest upon floor 52. Thus device 10 may be placed against a wall 56 with the lower edges on the floor 52 in a stable condition.

Figure 8:
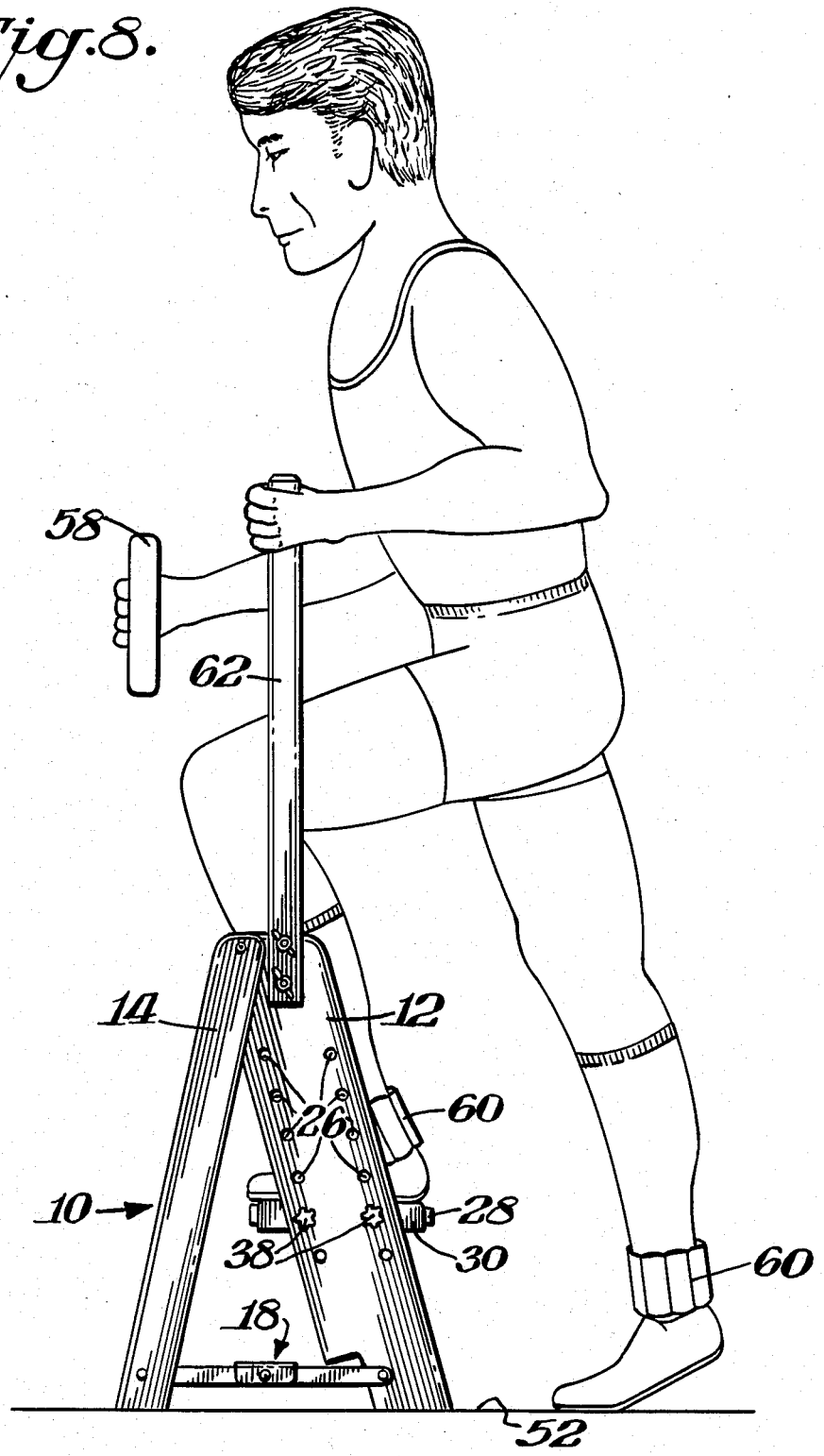
FIG. 8 is a side elevation view of a modified form of the device shown in FIGS. 1–7 and showing the device in use.

FIG. 8 shows the practice of this invention wherein resistance means are provided for the user during the exericise. The resistance means may take the form of weights 58 being held in the user's hands or may take other suitable forms such as ankle sleeves 60 which carry removable weights. For details of the ankle sleeve structure, reference is made to parent application Ser. No. 388,881.

FIG. 8 also shows a variation of device 10 wherein a handle 62 is provided, as described in the aforenoted application, should such be desired.

As can be appreciated, the present invention thus provides a device which is simple in structure and operation while providing the user with a range of versatility in selecting the proper exercise program. In addition, device 10 is so constructed as to be convenient to transport by means of its minimal parts and of being lightweight and is also convenient to store because of its small size and compactness when in a collapsed condition.

What is claimed is:

1. An adjustable stepping device comprising a frame consisting of a pair of side support units, each of said units comprising a front leg and a back leg, pivot means pivotally connecting said legs at their upper ends with respect to each other, brace means interconnecting front and back legs at a location remote from their pivotal connection to maintain said front and back legs at a fixed angle with respect to each other, a support member interconnecting said side support units for maintaining said support units a fixed distance from each other, a plurality of vertically spaced mounting elements on each of said front legs, each of said mounting elements on one of said front legs being associated with and coplanar with a corresponding mounting element in the other of said front legs whereby said mounting elements are arranged in vertically spaced sets, a step in the form of a horizontal support platform in contact with and detachably connected to said front legs by being selectively engaged to one of said sets of mounting elements for mounting said step at one of plurality of elevations, said step bridging said support units, said step being the forwardmost horizontal structural element bridging said support units, and said step being the sole support platform of said device, and the sole support platform spanning said front legs whereby a user may select the elevation of said platform and then step thereon, the length of said platform being less than the distance between said front legs, said mounting elements comprising holes extending completely through said front legs, said platform having corresponding holes in its side edges thereof, and fasteners removably extending through a set of said holes in said front legs and into said holes in said platform.

2. The device of claim 1 wherein said step has a width of a dimension greater than the width of each of said front legs.

3. The device of claim 1 wherein said step extends forwardly beyond said front legs when said device is in its operative condition.

4. The device of claim 1 wherein said support member comprises a rod spanning said back legs and connected thereto, said front legs having notches for accommodating said rod when said device is in its collapsed condition said back legs being spaced a greater distance apart than the distance between said front legs, said front legs being between said back legs when said device is in its collapsed condition, said front legs being wider than said back legs, and said back legs being conformed within the periphery of said front legs when said device is in its collapsed condition.

5. The device of claim 1 wherein said mounting elements are spaced from the lower edge of said front legs a distance between 8 inches and 18 inches.

6. The device of claim 1 including a post spanning said support units at the upper ends of said legs and extending through said upper ends of said front and said back legs, said post comprising a shaft about which said upper ends may pivot to comprise the pivotal connection for said legs, and said rod comprising a carrying handle for said device.

7. The device of claim 6 wherein said shaft is said support member.

8. The device of claim 6 including resistance means for attachment to said user, said resistance means comprising weights, and said weights and device being a kit.

9. The device of claim 8 wherein said resistance means comprises sleeve members having pockets in which said weights are mounted, and said sleeve members having adjustable fastening means for mounting on the user.

10. The device of claim 1 wherein each of said fasteners includes a locking pin for insertion into said holes and a knob mounted at the remote end of each locking pin, each pair of front and back legs being spaced from each other a distance sufficient to accommodate said fasteners when said device is in its collapsed condition, and said back legs extending outwardly beyond said knobs when said device is in its collapsed condition.

11. The device of claim 10 wherein each of said locking pins is externally threaded and terminate with a smooth pointed end, and said bracket holes being internally threaded for threaded engagement with said locking pins.

12. The device of claim 10 wherein the lower edges of said front legs are in line with a corner of said rear legs when said device is in its collapsed condition.

13. The device of claim 12 wherein said mounting elements are disposed a distance of from 10 inches to 18 inches above said lower edges of said front legs.

14. The device of claim 13 wherein said sets of mounting elements are arranged at 2 inch increments, and said step being about 9½ inches wide and about 20 inches long.

15. The device of claim 14 wherein an L-shaped bracket is provided along the side edges of said step, and said bracket having holes aligned with said holes in said side edges of said step.

16. An adjustable steppng device comprising a frame consisting of a pair of side support units, each of said units comprising a front leg and a back leg, pivot means pivotally connecting said legs at their upper ends with respect to each other, brace means interconnecting front and back legs at a location remote from their pivotal connection to maintain said front and back legs at a fixed angle with respect to each other, a support member interconnecting said side support units for maintaining said side support units a fixed distance from each other, a plurality of vertically spaced mounting elements on each of said front legs, each of said mounting elements on one of said front legs being associated with and coplanar with a corresponding mounting element in the other of said front legs whereby said mounting elements are arranged in vertically spaced sets, a step in the form of a horizontal support platform in contact with an detachably connected to said front legs by being selectively engaged to one of said sets of mounting elements for mounting said step at one of a plurality of elevations, said step bridging said support units, said step being the forwardmost horizontal structural element bridging said support units, and said step being the sole support platform of said device, and the sole support platform spanning said front legs whereby a user may select the elevation of said platform and then step thereon said support member comprises a rod spanning said back legs and connected thereto, said front legs having notches for accommodating said rod when said device is in its collapsed condition said back legs being spaced a greater distance apart than the distance between said front legs, said front legs being between said back legs when said device is in its collapsed condition, said front legs being wider than said back legs, and said back legs being conformed within the periphery of said front legs when said device is in its collapsed condition.

17. The device of claim 16 wherein said step has a width of a dimension greater than the width of each of said front legs.

18. The device of claim 16 wherein said step extends forwardly beyond said front legs when said device is in its operative condition.

19. The device of claim 16 including a post spanning said support units at the upper ends of said legs and extending through said upper ends of said front and back legs, said post comprising a shaft about which said upper ends may pivot to comprise the pivotal connection for said legs, and said rod comprising a carrying handle for said device.

20. The device of claim 16 including resistance means for attachment to said user, and said resistance means comprising weights.

21. The device of claim 16 wherein said mounting elements are spaced from the lower edge of said front legs a distance between 8 inches and 18 inches.

* * * * *